US007981315B2

(12) United States Patent
Lu et al.

(10) Patent No.: US 7,981,315 B2
(45) Date of Patent: Jul. 19, 2011

(54) POLAR MOLECULE DOMINATED ELECTRORHEOLOGICAL FLUID

(75) Inventors: Kunquan Lu, Beijing (CN); Rong Shen, Beijing (CN); Xuezhao Wang, Beijing (CN)

(73) Assignee: Institute of Physics, Chinese Academy of Sciences, Beijing (CN)

( * ) Notice: Subject to any disclaimer, the term of this patent is extended or adjusted under 35 U.S.C. 154(b) by 193 days.

(21) Appl. No.: 12/335,383

(22) Filed: Dec. 15, 2008

(65) Prior Publication Data

US 2009/0152513 A1 Jun. 18, 2009

Related U.S. Application Data

(63) Continuation-in-part of application No. PCT/CN2007/001890, filed on Jun. 15, 2007.

(30) Foreign Application Priority Data

Jun. 15, 2006 (CN) ..... 2006 1 0012255

(51) Int. Cl.
*C09K 5/00* (2006.01)

(52) U.S. Cl. ..... 252/73; 252/74; 252/512

(58) Field of Classification Search ..... None
See application file for complete search history.

(56) References Cited

U.S. PATENT DOCUMENTS

| | | | |
|---|---|---|---|
| 5,294,360 | A | 3/1994 | Carlson et al. |
| 6,852,251 | B2 | 2/2005 | Shen et al. |
| 2005/0285085 | A1 | 12/2005 | Wen et al. |

FOREIGN PATENT DOCUMENTS

| | | | |
|---|---|---|---|
| CN | 1190119 | A | 8/1998 |
| CN | 1454976 | A | 11/2003 |
| CN | 1490388 | A | 4/2004 |
| CN | 1752195 | A | 3/2006 |
| CN | 1752196 | A | 3/2006 |
| CN | 1768913 | A | 5/2006 |
| CN | 1944606 | A | 4/2007 |

OTHER PUBLICATIONS

Gong, X., et al., "Organic Chemical Modification of Nano Titania, Barium Titanate and Their Electrorheological Effect," Journal of Functional Materials 5:693-695 (2006).

(Continued)

*Primary Examiner* — Necholus Ogden, Jr.
(74) *Attorney, Agent, or Firm* — Manni Li; Mei & Mark LLP

(57) ABSTRACT

Polar molecules dominated electrorheological fluids mainly comprising a mixture of dispersed phase of solid particles and/or dispersing liquid medium. The dispersed phase solid particles, on the surface, or the liquid dispersing medium contain polar molecules or polar groups, the dipole moment of which is 0.5-10 deb and the size is between 0.1 nm and 0.8 nm. Dispersed phase solid particles are spherical or nearly spherical, of which the size is 10-300 nm and dielectric constant is higher than 50. The conductance rate of the liquid dispersing medium is lower than $10^{-8}$ S/m, and the dielectric constant is lower than 10. The PM-ER fluids possess the characteristics of high yield strength, high dynamic shear strength, low leakage current, the linear dependence of yield strength on electric field, and high yield strength at low electric field, etc. The yield strength improves to almost 100 times of that of ordinary ER fluids and reaches to more than 200 Kpa.

13 Claims, 5 Drawing Sheets

OTHER PUBLICATIONS

Wang, X., et al., "The Research on Calcium Titanate Nanoparticle EP Fluid," Journal of Functional Materials 5:681-683 (2006).
Winslow, W.M., "Induced Fibration of Suspensions," Contributed Organic Research, vol. 20: 1137-1140 (1949).
Ma, H.R., et al., "Frequency Dependent Electrorheological Properties: Origin and Bounds," Physical Review Letters, 77: 2499-2502 (1996).
Shen, R. et al., "TiO2 based electrorheological fluid with high yield stress," International Journal of Modern Physics B, vol. 19: 1104-1109 (2005).

POLAR MOLECULE DOMINATED ELECTRORHEOLOGICAL FLUID

CROSS-REFERENCE TO RELATED APPLICATIONS

The subject application is a continuation-in-part of PCT/CN2007/001890 filed on Jun. 15, 2007 which claims priority from Chinese patent application CN 200610012255.5 filed on Jun. 15, 2006. The contents of both priority applications are incorporated herein by reference.

FIELD OF THE INVENTION

The present invention relates to novel electrorheological fluid, particularly, polar molecule dominated electrorheological fluid.

BACKGROUND OF THE INVENTION

The electrorheological (ER) fluid is made of nano-particles or micro-particles suspended in insulating liquid. The shear strength of the fluid may be continuously adjusted electrically, and the material may undergo liquid to solid transition within milliseconds. The outstanding characters of the fluid, including its continuously adjustable shear strength, quick response, and reversible transition, make it an intelligent material with tunable hardness having broad and important applications. The material may be used in the clutch, damping system, damper, braking system, automatic transmission, liquid valve, mechanoelectrical coupling control, robotics, etc., making it possible consolidated intelligent mechanoelectrical control. The material may be applied in almost all industrial and technological fields and has wide application in military fields.

Since the ER fluid was invented by Winslow in the 1940s, however, the material has not been widely applied as expected. The lack of application is due to its relatively low shear strength, usually about several kPa and 10 kPa at the most, high leakage current, and tendency towards settling. The working principle of the ER fluid is generally as follows: in an electric field, particles are polarized and become attracted to each other, the shear strength increases as the intensity of the electric field increases. The ER fluid based on the attraction of the polarized particles is referred to as the "ordinary ER fluid" or "dielectric ER fluid." The upper limit in the shear yield strength for this type of material is 10 kPa (1 kV/mm). Such low shear strength makes it impossible meeting the requirements for technological and industrial applications. In the late 1990s, Institute of Physics, Chinese Academy of Sciences, invented surface modified complex strontium titanate ER fluid (Chinese Patent No. CN 1190119), which may has the shear yield strength up to only 30 kPa at an electric field of 3 KV/mm.

Current literature and patents mostly disclose the material and technology of the ordinary ER fluid. CN1490388 discloses an ER fluid made of urea-coated barium titanate nanoparticles called the giant ER fluid. The patent discloses complex particles and a promoter which contains urea, butyramide, and acetamide. The static yield strength of the giant ER fluid may reach 130 kPa due to the coating layer surrounding the surface of the particles. The theoretical basis is named the theory of Coating Layer Saturated Polarization. The main drawbacks of the giant ER fluid are the necessity of the surface coating of the particles, high current density (several hundred $\mu A/cm^2$) as reported, low yield strength at low electric field, e.g., only 30-40 kPa at 2 kV/mm, and the phase transition of barium titanate at around 120° C. All of the drawbacks restrain the application of the material. A doped titanium oxide ER fluid and method for preparing the same have been reported in the literature. The doped micro- or nano-particles of titanium dioxide are prepared by mixing highly polarized molecules of amides or their derivatives in titanium dioxide via the sol-gel method. Then, the doped particles are mixed with methyl silicon oil at a volume percentage of 30% to obtain a high yield strength ER fluid. CN1752195 discloses a calcium titanate ER fluid and method for preparing the same. The composition mainly consists of an anhydrous calcium titanate ER fluid. The ER fluid is prepared by preparing calcium titanate particles via oxalic acid co-precipitation and mixing the prepared particles with dimethyl silicon oil at a volume percentage of 30%. The ER fluid exhibits strong ER effect, its yield strength may reach more than 100 kPa. However, these ER fluids can not be widely applied due to their high current leakage density and limitations on the preparation material.

DESCRIPTION OF THE INVENTION

The present invention provides a polar molecule dominated electrorheological (PM-ER) fluid which has the characteristics of high shear strength, stability against settling, and low leakage current. The PM-ER fluid of the present invention overcomes the disadvantages of the ER fluid including low shear strength, limitations on the preparation material, and failure to meet the engineering requirements.

The present invention provides a PM-ER fluid which comprises a mixture of dispersed solid particles in a dispersing liquid medium as follows:

(1) dispersed solid particles, on their surface, and/or liquid dispersing medium contain polar molecules or polar groups which are 0.5-10 Debey in dipole moment and 0.1-0.8 nm in size;

(2) dispersed solid particles spherical or quasi-spherical in shape, the size of the particles is in the range of 10-300 nm, preferably, 20-100 nm, and the dielectric constant is more than 50;

(3) the conductance rate of the dispersing liquid medium is lower than $10^{-8}$ S/m, the dielectric constant is less than 10.

The polar molecules or polar groups of the present invention have at least one contributing polar bond that is C═O, O—H, N—H, F—H, C—OH, C—$NO_2$, C—H, C—$OCH_3$, C—$NH_2$, C—COOH, C—Cl, C—S, S—H, or N═O.

The polar molecules or polar groups on the surface of the dispersed solid particles of the present invention are added or retained during the preparation of the dispersed solid particles, or are added or assembled to the surface of the prepared particles. The molar percentage of the polar molecules or polar groups in the dispersed phase is 0.01-50%.

The polar molecules or polar groups in the dispersing liquid medium of the present invention have a molar percentage of 0.1-100%.

In the PM-ER fluid of the present invention, the dispersed phase of solid particles and the dispersing medium of liquid are thoroughly mixed, and the volume percentage of the dispersed solid particles in the ER fluid is 5-50%.

The polar molecules or polar groups in the PM-ER fluid of the present invention may be on the surface of the particles which are added or retained during the preparation of the particles, in which case these polar molecules or polar groups form part of the solid particles, or added or assembled to the prepared particles, in which case these polar molecules or polar groups are additional molecules or groups to the particles. No matter how these polar molecules or polar groups are added, the polar molecules or polar groups that contribute to the electrorheological property of the fluid are those absorbed onto or exposed on the surfaces of particles. The dispersing liquid medium of the present invention is one or more selected from silicon oil, mineral oil, engine oil, hydrocarbon oil, and other known liquid dispersing media or any polar liquid containing at least one of the polar molecules or polar groups.

The polar molecules or polar groups in the PM-EF fluid of the present invention may be contained in the dispersing medium. The dispersing medium may be a polar liquid of a single chemical composition, or mixture liquid containing polar molecules or polar groups. When the polar molecules or polar groups are contained in the dispersing medium, solid particles in the dispersed phase may or may not contain polar molecules or polar groups.

In the PM-EF fluid of the present invention, particles with high dielectric constant are used which may be inorganic, organic, or organo-inorganic compounds, and the particles may be prepared by gas phase, liquid phase, or solid phase synthesis.

In the PM-EF fluid of the present invention, during the preparation process, the solid particles in the dispersed phase and the liquid dispersing medium are thoroughly mixed by ultrasonic or in ball grinding mill.

In the present invention, polar molecules or polar groups are added in the dispersed phase and/or dispersing medium or contained in them. Under an electric field, the particles in the PM-EF fluid get polarized and attracted to each other and become closer, and the intensity of the local electric field increases as the particles draw closer, which may be about thousand times higher than that of the external electric field. Under the effect of the high local electric field, the polar molecules or polar groups within the local region align along the direction of the electric field, and these aligned polar molecules and the polarization charge on the particles are strongly attracted so that the shear yield strength of the PM-EF fluid greatly improves over the ordinary EF fluid. T he longer the dipole moment of the contributing polar molecules or polar groups, the smaller the size thereof, or the more the number thereof, the higher the yield strength of the fluid. Once the electricity is cut off, the localized electric field disappears, the aligned polar molecules resume the irregular absorbed state, the polarization charge disappears, and thus, the electrorheological effect caused by the electric field disappears.

The PM-ER fluid of the present invention has remarkable electrorhieological characteristics. Both polar molecules or polar groups and spherical particles with high dielectric constant are critical in contributing to the increase in the electrorheological effect. The yield strength is increased and has a linear correlation to the intensity of the electric field. The material exhibits high yield strength under low electric field, which is improved hundreds of times over the traditional EF fluid, up to over 200 kPa. The dynamic shear strength is also improved to above 60 kPa at an electric field intensity of 3 kV/mm. The PM-ER fluid of the present invention possesses good stability against sedimentation and low leakage current. When the electric field intensity is at 5 kV/mm, the electric density is less than 20 $\mu A/cm^2$.

DETAILED EMBODIMENTS

EXAMPLE 1

Figure 1:
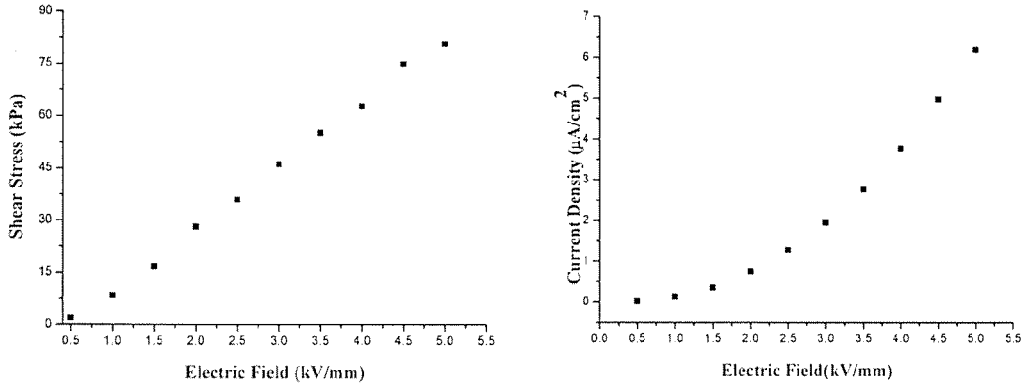
FIG. 1 shows the shear yield strength of an ER fluid of titanium oxide nanoparticles with the polar groups of C═O and C—$NH_2$ as function of electric field (left), and corresponding current density (right).

The ER fluid of titanium oxide nanoparticles with the polar groups of C═O and C—$NH_2$ are prepared by addition of acetamide. The dispersed phase contains the titanium oxide nanoparticles, and the dispersing medium is silicon oil. The titanium oxide particles are in spherical shape with diameter range of 50-100 nm and dielectric constant of 1000. The dipole moment of the polar group C═O and C—$NH_2$ is 2.3-2.76 deb and 1.2-1.5 deb, respectively. The polar groups C═O and C—$NH_2$, comprise 20 molar percent of the prepared titanium oxide nanoparticles.

(1) Preparation of titanium oxide nanoparticles with polar groups C═O and C—$NH_2$ via doping acetamide The particles are prepared by the sol-gel method:

Composition 1: 30 ml $Ti(OC_4H_9)_4$ is dissolved in 210 ml dehydrated ethanol, and the PH value is adjusted to 1-3 by hydrochloric acid solution. Composition 2: 40 ml deionized water and 150 ml dehydrated ethanol are homogeneously mixed.

Composition 3: 30 g acetamide is dissolved in 20 ml deionized water.

With strong stirring, composition 2 is added into composition 1, then composition 3 is added immediately; the mixed solution is stirred continuously to form a colorless transparent gel. The gel is aged at room temperature until some liquid separates out, then, dried to white powder in vacuum at low temperature. After several washings, centrifugation, and filtering, the powder is dried at 50° C. for more than 48 hours and then at 120° C. for 3 hours to obtain the titanium oxide spherical particles with the polar groups of C═O and C—$NH_2$. The size is in the range of 50-100 nm and dielectric constant is about 1000. The polar groups C═O and C—$NH_2$ comprise 20 molar percent of the prepared titanium oxide nanoparticles.

(2) Titanium oxide nanoparticles with polar groups C═O and C—$NH_2$ are mixed with 10# silicon oil in a ball grinding mill for more than 3 hours so that the particles are completely dispersed to form the ER fluid. The particles comprise 30% by volume of the total volume. The shear yield strength reaches 100 kPa, and the current density is lower than 10 $\mu A/cm^2$ as shown in FIG. 1

EXAMPLE 2

Figure 10:
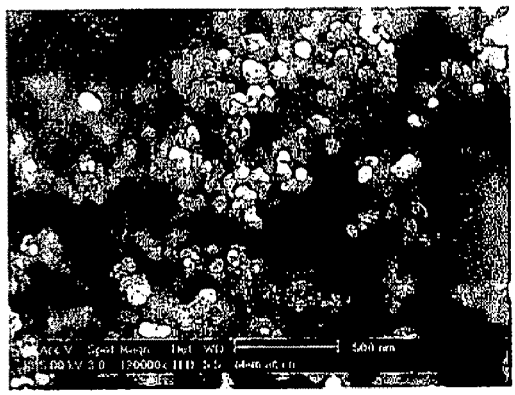
FIG. 10 is a scanning EM photo of titanium dioxide particles prepared by the present invention.

The ER fluid of titanium oxide nanoparticles with the polar groups of C═O and C—$NH_2$ are prepared by doping of urea. The dispersed phase contains the titanium oxide nanoparticles, and the dispersing medium is silicon oil. FIG. 10 shows the scanning EM photo of the prepared titanium oxide nanoparticles, which are in spherical shape with an average diameter of 50 nm and dielectric constant of about 500. The dipole moment of the polar groups C═O and C—$NH_2$ is 2.3-2.76 deb and 1.2-1.5 deb, respectively. The polar groups C═O and C—$NH_2$ comprise 15 molar percent of the prepared titanium oxide nanoparticles.

(1) Preparation of titanium oxide nanoparticles with polar groups C═O and C—$NH_2$ via doping urea.

The particles are prepared by the sol-gel method:

Composition 1: 30 ml $Ti(OC_4H_9)_4$ is dissolved in 150 ml dehydrated ethanol, and the PH value is adjusted by hydrochloric acid solution.

Composition 2: 40 ml deionized water is dissolved in 250 ml dehydrated ethanol, and 2 ml diethanol amine is added to adjust the hydrolysis condensation reaction of tetra-n-butyl titanate.

Composition 3: 30 g urea is dissolved in 20 ml water.

With strong stirring, composition 2 is added dropwise into composition 1, then, composition 3 is added immediately; the mixed solution is stirred continuously to form a colorless transparent gel. The gel is aged at room temperature for 7 days and dried to white powder in vacuum at low temperature. After several washings by deionized water and dehydrated ethanol, centrifugation, and filtering, the powder is dried at 50° C. for 48 hours and then at 120° C. for 3 hours to obtain the titanium oxide spherical particles with the polar groups of C═O and C—$NH_2$ with an average size of 50 nm and dielectric constant of about 500. The dipole moment of the polar groups C═O and C—$NH_2$ is 2.3-2.76 deb and 1.2-1.5 deb, respectively. The polar groups C═O and C—$NH_2$ comprise 15 molar percent of the prepared particles.

Figure 2:
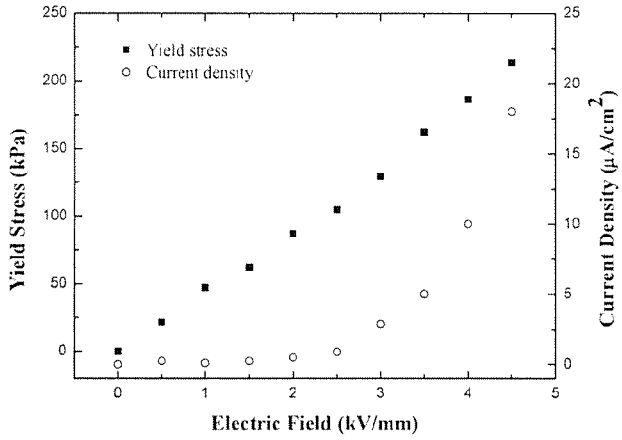
FIG. 2 shows the shear yield strength and current density of an ER fluid of titanium oxide nanoparticles with the polar groups of C═O and C—$NH_2$ as function of electric field.
Figure 3:
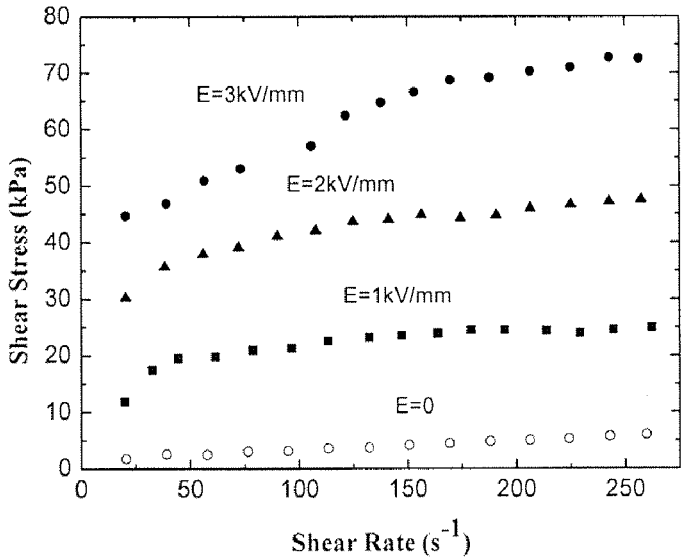
FIG. 3 shows the dynamic shear strength of an ER fluid of titanium oxide nanoparticles with the polar groups of C═O and C—$NH_2$ as function of shear change rate under different electric field.

(2) titanium oxide nanoparticles are mixed with 10# silicon oil in a ball grinding mill for more than 3 hours so that the particles are completely dispersed to form the ER fluid. The particles comprise 30% by volume of the total volume. The shear yield strength reaches more than 200 kPa, as shown in FIG. 2, while the current density is lower than 20 $\mu A/cm^2$; when the electrical field is 2 kV/mm, the shear strength may reach 100 kPa; at 3 kV/mm, the dynamic shear strength reaches more than 60 kPa, as shown in FIG. 3.

EXAMPLE 3

The ER fluid of titanium oxide nanoparticles with the polar groups of O—H and C═O have a dispersed phase of titanium oxide and a dispersing medium of silicon oil. The polar groups are retained during the preparation of the titanium oxide nanoparticles. The titanium oxide nanoparticles are spherical in shape with an average diameter of 50 nm and dielectric number of about 500. The dipole moment of the polar groups O—H and C═O is 1.51 deb and 2.3-2.76 deb, respectively. The polar groups O—H and C═O comprise 5 molar percent of the nanoparticles.

First, tetra-n-butyl titanate is used as the starting material, water as the reacting reagent, and dehydrated ethanol as the solvent. With strong stirring, ethanol solution of water is added dropwise into dehydrated ethanol solution of tetra-u-butyl titanate, and the mixture is stirred continuously to form a gel. The gel is aged for several days and vacuum dried to white powder. After many washings, centrifugation, and filtering, the powder is dried at 50° C. in oven for more than 72 hours and then at 120° C. for 2 hours to obtain the titanium oxide nanoparticles. The particles are spherical in shape with an average size of 50 nm. The amount of polar groups O—H and C═O that are retained in the particles is controlled by the washing time and frequency. The polar groups O—H and C═O comprise 5 molar percent of the particles; the dipole moment is 1.51 and 2.3-2.7 deb, respectively.

Figure 4:
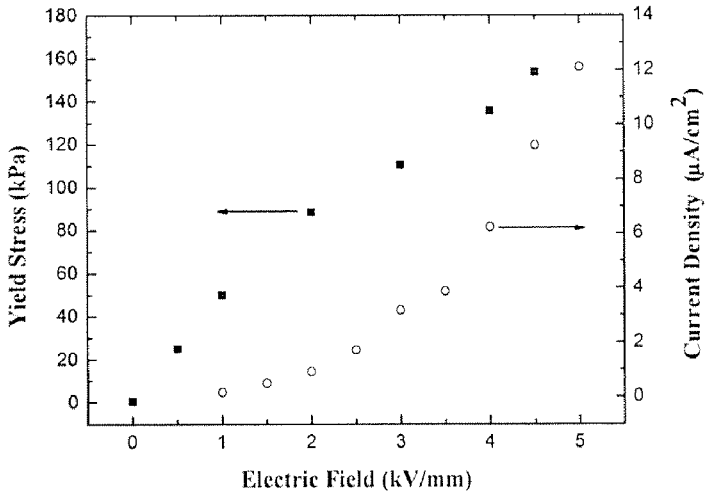
FIG. 4 shows the shear yield strength and current density of an ER fluid of titanium oxide nanoparticles with the polar groups of O—H and C═O as function of electric field.

(2) titanium oxide nanoparticles are mixed with dimethyl silicon oil having a viscosity of 200 $mm^2/s$ in a ball grinding mill for more than 3 hours so that the particles are completely dispersed to form the ER fluid. The particles comprise 30% by volume of the total volume. The shear yield strength reaches more than 150 kPa, as shown in FIG. 4. When the electrical field is 2 kV/mm, the yield strength may reach 100 kPa. When the electrical field is 5 kV/mm, the current density is lower than 20 $\mu A/cm^2$.

EXAMPLE 4

The ER fluid of calcium titanate nanoparticles with the polar groups with a dispersed phase of calcium titanate nanoparticles and dispersing medium of silicon oil. The polar groups O—H and C═O are retained during the preparation of the calcium titanate nanoparticles. The calcium titanate nanoparticles are spherical in shape with an average diameter of 50 nm and dielectric constant of about 300. The dipole moment of the polar groups O—H and C═O is 1.51 deb and 2.3-2.7 deb, respectively. The polar groups O—H and C═O comprise 25 molar percent of the particles.

(1) Preparation of calcium titanate nanoparticles via co-precipitation.

Composition 1: 30 ml titanium tetrachloride is homogenously mixed in dehydrated ethanol at a molar ratio of 1:25.

Composition 2: dehydrated calcium chloride is dissolved in deionized water at 2 mol/l to obtain its aqueous solution.

Compositions 1 and 2 are thoroughly stirred and mixed at 60° C. water bath, and the pH is adjusted to 4 by adding hydrochloric acid to get a mixed solution of 1+2.

Composition 3: oxalic acid is dissolved in deionized water to obtain a solution of 2 mol/l.

Composition 3 is added dropwise into the mixture solution of 1+2, and the volume ratio in the mixture of the 3 compositions is 2:1:2. The precipitation formed from the mixture is aged at 60° C. for 12 hours, washed by deionized water, filtered, dried for more than 120 hours, and again dried at 120° C. for 3 hours to obtain the spherical calcium titanate nanoparticles of a size of 50-100 nm. The amount of polar groups O—H and C═O that are retained in the particles is controlled by the washing time and frequency. The analysis under infrared spectrometry confirms that the polar groups O—H and C═O comprise 25 molar percent of the particles, and the dipole moment of the polar groups O—H and C═O is 1.51 and 2.3-2.7 deb, respectively.

Figure 5:
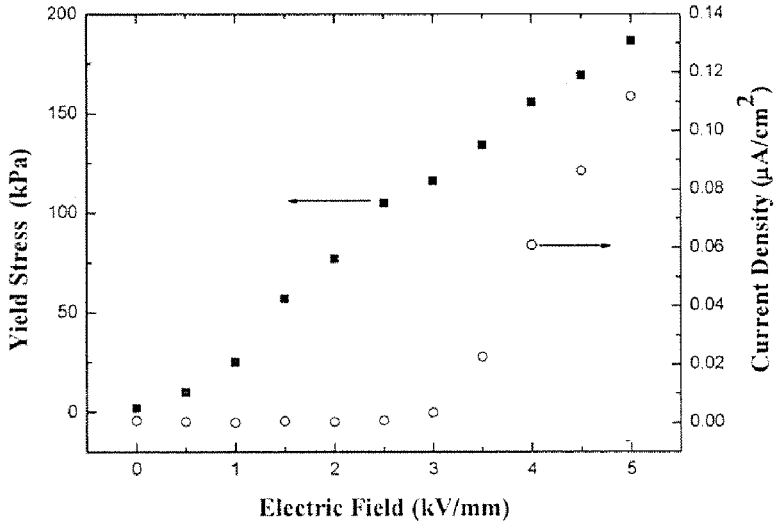
FIG. 5 shows the shear yield strength and current density of an ER fluid of calcium titanate nanoparticles with the polar groups of O—H and C═O as function of electric field.

(2) calcium titanate particles are mixed with methyl silicon oil having a viscosity of 50# in a ball grinding mill for more than 3 hours so that the particles are completely dispersed to form the ER fluid. The particles comprise 30% by volume of the total volume. When the electrical field is 5 kV/mm, the yield strength may reach 200 kPa, and the current density is lower than 1 $\mu A/cm^2$. When the electrical field is 2 kV/mm, the yield strength may reach 90 kPa as shown in FIG. 5.

EXAMPLE 5

The ER fluid of lanthanum lithium titanate nanoparticles with the polar groups have a dispersed phase of lanthanum lithium titanate nanoparticles and a dispersing medium of silicon oil. The polar groups O—H and C═O are retained during the preparation of the lanthanum lithium titanate nanoparticles. The particles are spherical in shape with an average size of 50 nm and dielectric constant of about 400. The polar groups O—H and C═O comprise 15 molar percent of the particles. The dipole moment of the polar groups O—H and C═O is 1.51 and 2.3-2.7 deb, respectively.

(1) lanthanum lithium titanate nanoparticles are prepared by co-precipitation as the following steps: $LiCl.H_2O$, $LaCl_3.7H_2O$, and $Ti(OC_4H_9)_4$ are used as the starting material, oxalic acid($C_2H_2O_4.2H_2O$) is precipitator. The precipitation is formed with the formula $Li_{3x}La_{2/3-x}TiO(C_2O_4)_2$. The precipitation is washed with deionized water and ethanol for many times, filtered, and dried at 50° C. for more than 48 hours and then heated at 120° C. for 3 hours to obtain white $Li_{3x}La_{2/3-x}TiO(C_2O_4)_2$ particles. The particles are spherical in shape with an average size of 50 nm. The particles have the polar groups O—H and C═O comprising 15 molar percent of the particles.

(2) lanthanunm lithium titanate particles as prepared are mixed with dimethyl silicon oil having a viscosity of 200 $mm^2/s$ at 30% volume percentage in a ball grinding mill for more than 3 hours so that the particles are completely dispersed to form the ER fluid. The yield strength reaches more than 90 kPa, and the current density is lower than 20 $\mu A/cm^2$.

EXAMPLE 6

The ER fluid having form amide-absorbed strontium titanate nanoparticles are prepared from purchased strontium titanate particles, which has a dielectric constant of 300. Formamide solution and strontium titanate nanoparticles are homogeneously mixed at a molar ratio of 2:100. The dipole moment of polar molecule formamide is 3.73 deb. The mixture is heated at 50° C. for 2 hours, and formamide is absorbed on the strontium titanate nanoparticles. The particles are homogenously mixed with dimethyl silicon oil of 200 $mm^2/s$ at 30% volume percentage to form the ER fluid. The yield strength may reach 20 kPa, which is much higher than that of the ordinary strontium titanate ER fluids without formamide (less than 1 kPa). The yield strength of the ER fluid made cannot reach a higher value because the purchased strontium titanate particles are not spherical but quadrate.

EXAMPLE 7

The ER fluid with a dispersing medium having polar molecules or polar groups is prepared by homogenously mixing ethyl acetate and silicon oil having a viscosity of 200 $mm^2/s$ at a molar ratio of 3:10 to form a uniform liquid. The dipole moment of ethyl acetate is 1.78 deb. Strontium titanate particles as purchased is mixed in the above dispersing medium as the dispersed phase to form the ER fluid, whose size is in the range of 100-200 nm and dielectric constant of 300. The yield strength of the ER fluid may reach 30 kPa, which greatly improves over that of the ordinary ER fluid made by a mixture of strontium titanate particles and pure silicon oil (lower than 1 kPa). The yield strength of the ER fluid made cannot reach a higher value because the purchased strontium titanate particles are not spherical but quadrate.

If the molar ratio of ethyl acetate mixing with silicon oil is 0.5:10, 1:10, or 2:10, similar results may also be obtained.

Comparative Example 1

Barium titanate particles or strontium titanate particles with a size in the range of 100-200 nm as used in Examples 6 and 7 are homogenously mixed with dimethyl silicon oil having a viscosity of 200 $mm^2/s$ to form ER fluids, in which the volume percentage of barium titanate or strontium titanate particles is 30%, and the shear yield strength is both less than 1 kPa.

Comparative Example 2

Figure 6:
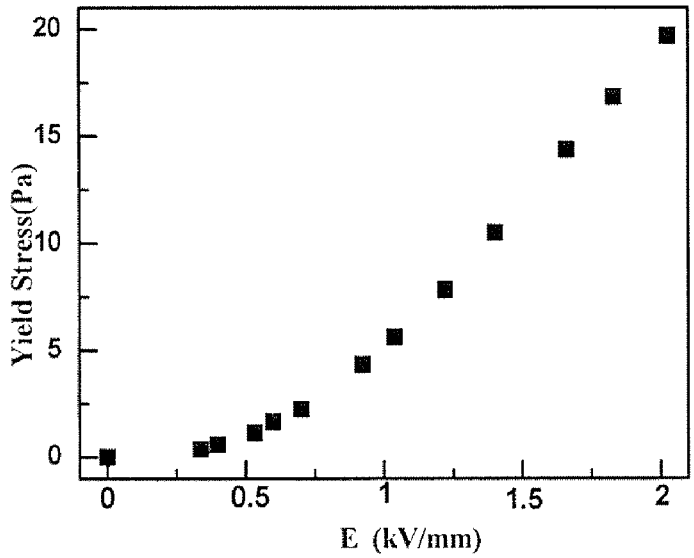
FIG. 6 shows the shear yield strength of an ER fluid of ordinary titanium oxide particles, without polar molecules or polar groups, as function of electric field.

Ordinary $TiO_2$ particles having a size of 200 nm are homogeniously mixed with silicon oil having a viscosity of 200 $mm^2/s$, with a volume percentage of 30% for the particles, to form the ER fluid without polar groups or polar molecules, of which the shear yield strength is only tens of Pa as shown in FIG. 6. It is the typical ordinary ER fluid.

Comparative Example 3

The titanium oxide nanoparticles with the polar groups C═O and C—$NH_2$ prepared by doped urea in Example 2 and calcium titanate nanoparticles with the polar groups O—H and C═O prepared in Example 4 are heated at 500-800° C. for 2 hours. As confirmed by the Infrared spectrum try, the polar molecules and polar groups are removed completely. The heated particles are homogenously mixed with dimethyl silicon oil having a viscosity of 200 $mm^2/s$ to form the ER fluids at a volume percentage of 30%; the ER fluid loses its high shear yield strength.

Figure 7:
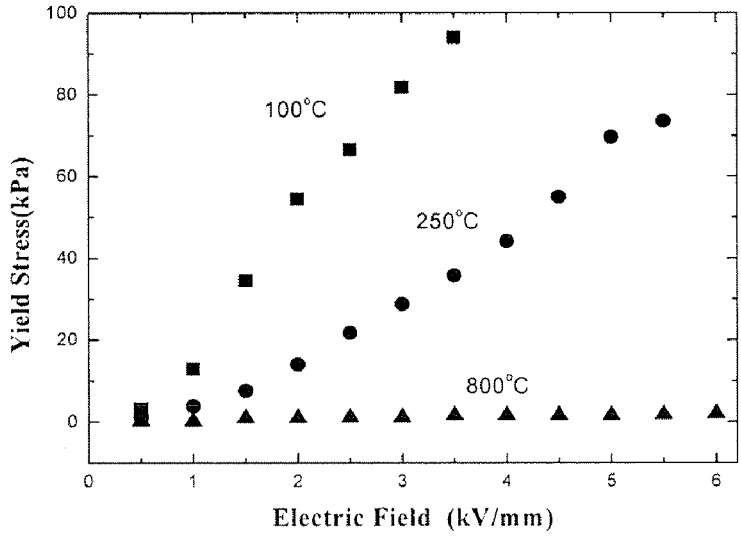
FIG. 7 shows the shear yield strength characteristics of ER fluids of titanium oxide nanoparticles with the polar groups of C═O and C—$NH_2$ heated at different temperatures.

Titanium oxide nanoparticles having the polar groups C═O and C—$NH_2$ are heated at 800° C. for 2 hours, and then, are used to prepare the ER fluid; the ER fluid completely loses its high shear yield strength as shown in FIG. 7.

Figure 8:
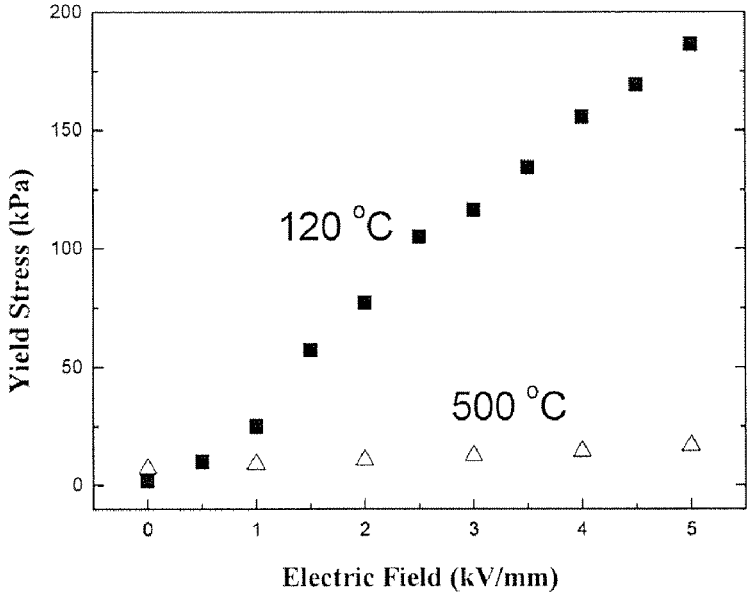
FIG. 8 shows the shear yield strength characteristics of an ER fluid of calcium titanate nanoparticles with the polar groups of O—H and C═O heated at 500° C. for 2 hours.

Calcium titanate nanoparticles having the polar groups O—H and C═O are heated at 500° C. for 2 hours, and then, are used to prepare the ER fluid: the ER fluid completely loses its high shear yield strength as shown in FIG. 8.

Particles with polar molecules or polar groups are heated at a high temperature to remove the polar molecules or polar groups. The shear yield strength of the ER fluid prepared by these heated particles is very low, comparing to the ER fluids with the polar molecules or polar groups which have high shear yield strength.

Comparative Example 4

Figure 9:
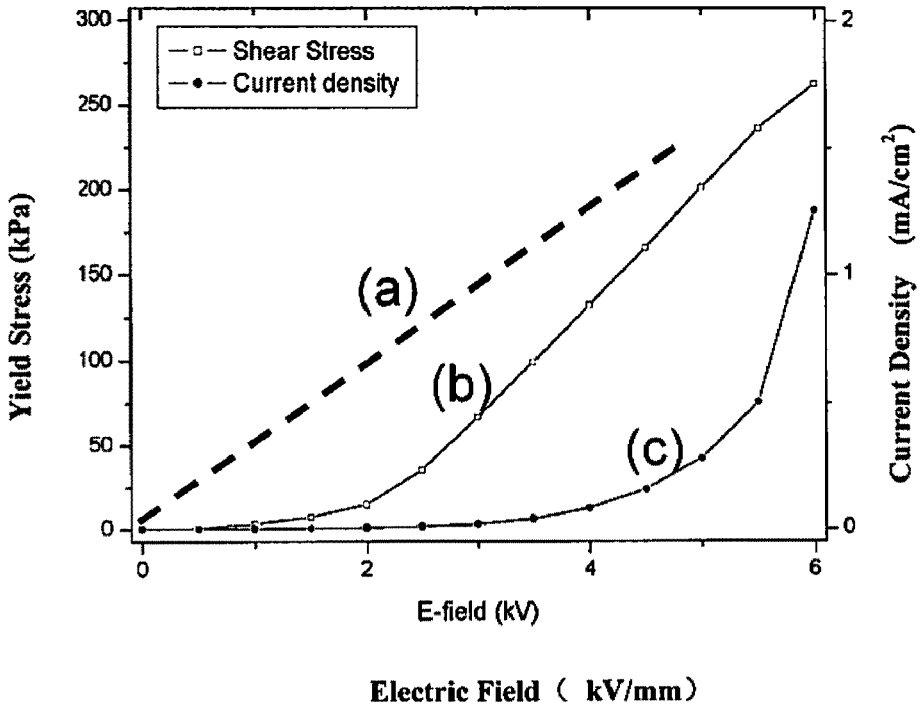
FIG. 9 shows the comparison of an ER fluid of urea-covered barium titanate and typical results of the PM-ER fluid of the present invention (Example 2), (a) the correlation of the yield strength of the PM-ER fluid of the present invention to the electric field, (b) the correlation of the yield strength of the ER fluid of urea-covered barium titanate to the electric field, (c) the correlation of the current density of the ER fluid of urea-covered barium titanate to the electric field.

The ER fluid as prepared in Example 2 is compared with the ER fluid of barium titanate nanoparticles coated with urea as prepared by the method described in CN1490388. As shown in FIG. 9, at 2 kV/mm, the yield strength of the ER fluid of the urea-covered barium titanate nanoparticles is about 30 kPa, and that of the ER fluid in example 2 is about 100 kPa. Moreover, the yield strength of the ER fluid in Example 2 is in linear correlation to electric field. At 5 kV/mm, the leakage current density of the ER fluid of urea-covered barium titanate is 300 $\mu A/cm^2$. At 5 kV/mm, the leakage current density of the ER fluid of Example 2 is below 20 $\mu A/cm^2$, some of which even 1 $\mu A/cm^2$, as shown, in FIG. 5, which is 10 to 100 times lower that the leakage current density of the urea-covered barium titanate ER fluid. The PM-ER fluids of the present invention have been shown to have high yield strength, high dynamic shear strength, low leakage current, the linear correlation between the yield strength and the electric field strength, and high yield strength at low electric field.

The invention claimed is:

1. Polar molecules dominated electrorheological (PM-ER) fluids comprising a mixture of dispersed phase of solid particles and liquid dispersing medium, wherein the solid particles contain polar molecules or polar groups, at least a portion of the polar molecules or polar groups comprising at least one functioning polar bond that is C═O, O—H, N—H, F—H, C—OH, C—NO2, C—H, C—OCH3, C—NH2, C—COOH, C—C1, C—S, S—H, or N═O; are exposed on the surface of the solid particles or absorbed onto the surface of the solid particles; dipole moment of the polar molecules or polar groups is 0.5-10 deb and size is 0.1-0.8 nm; dielectric constant of the solid particles is higher than 50, the size of the solid particles is about 10-300 nm, and the polar molecules or polar groups comprise about 0.01-50 molar percent of the dispersed phase, and conductance of the liquid medium is lower than $10^{-8}$ S/m, and dielectric constant of the liquid medium is lower than 10.

2. The PM-ER fluids as claimed in claim 1, wherein said polar molecules or polar groups comprise about 0.1-100 molar percent of the liquid medium.

3. The PM-ER fluids as claimed in claim 1, wherein said solid particles are thoroughly mixed with said liquid medium, and volume fraction of the solid particles of the dispersed phase in the PM-ER fluids is about 5-50%.

4. The PM-ER fluids as claimed in claim 1, wherein said solid particles comprise titanium dioxide, calcium titanate, lanthanum lithium titanate, or strontium titanate particles.

5. The PM-ER fluids as claimed in claim 1, wherein the solid particles are about 20-100 nm in size.

6. The PM-ER fluids as claimed in claim 1, wherein said polar molecules or polar groups are added or retained during preparation of the particles, or added to or assembled on the surfaces of the particles that have already been prepared.

7. The PM-ER fluids as claimed in claim 1, wherein the solid particles are spherical or nearly spherical.

8. Polar molecules dominated electrorheological (PM-ER) fluids comprising a mixture of dispersed phase of solid particles and liquid dispersing medium, wherein the liquid dispersing medium contains polar molecules or polar groups comprising at least one functioning polar bond that is C═O, O—H, N—H, F—H, C—OH, C—NO2, C—H, C—OCH3, C—NH2, C—COOH, C—C1, C—S, S—H, or N═O; and dipole moment of the polar molecules or polar groups is 0.5-10 deb and size is 0.1-0.8 nm, dielectric constant of the solid particles is higher than 50, conductance of the liquid medium is lower than $10^{-8}$ S/m, and dielectric constant of the liquid medium is lower than 10.

9. The PM-ER fluids as claimed in claim 8, wherein size of the solid particles is about 10-300 nm.

10. The PM-ER fluids as claimed in claim 9, wherein the solid particles are about 20-100 nm in size.

11. The PM-ER fluids as claimed in claim 8, wherein said polar molecules or polar groups comprise about 0.1-100 molar percent of the liquid medium.

12. The PM-ER fluids as claimed in claim 8, wherein said solid particles are thoroughly mixed with said liquid medium, and volume fraction of the solid particles of the dispersed phase in the PM-ER fluids is about 5-50%.

13. The PM-ER fluids as claimed in claim 8, wherein the solid particles are spherical or nearly spherical.

* * * * *